US007890046B2

(12) United States Patent
Hanada et al.

(10) Patent No.: US 7,890,046 B2
(45) Date of Patent: Feb. 15, 2011

(54) IMAGE FORMING SYSTEM, SHEET TREATING APPARATUS, IMAGE FORMING APPARATUS, CONTROL PROGRAM AND STORAGE MEDIUM

(75) Inventors: Takako Hanada, Yokohama (JP); Tsuyoshi Moriyama, Toride (JP); Akinobu Nishikata, Kashiwa (JP); Masayoshi Taira, Kashiwa (JP); Hiroaki Tomiyasu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 11/084,158

(22) Filed: Mar. 21, 2005

(65) Prior Publication Data

US 2005/0271445 A1 Dec. 8, 2005

(30) Foreign Application Priority Data

Mar. 23, 2004 (JP) ..... 2004-085512

(51) Int. Cl.
*G03G 15/00* (2006.01)
*B65H 37/04* (2006.01)

(52) U.S. Cl. ..... 399/407; 399/389; 399/408

(58) Field of Classification Search ..... 400/621, 400/579; 399/401, 395; 83/76.8; 270/58.08, 270/58.09

See application file for complete search history.

(56) References Cited

U.S. PATENT DOCUMENTS 5,758,251 A * 5/1998 Takahashi et al. ..... 399/395
6,065,383 A * 5/2000 Takaishi et al. ..... 83/368
6,219,503 B1 4/2001 Miyake et al. ..... 399/85
6,305,262 B1 * 10/2001 Watanabe ..... 83/670
6,330,422 B1 12/2001 Sato et al. ..... 399/382
6,337,970 B1 * 1/2002 Okamoto et al. ..... 399/407
6,371,472 B1 4/2002 Miyake et al. ..... 270/58.14
6,386,080 B1 * 5/2002 Okamoto et al. ..... 83/73
6,421,523 B1 7/2002 Kondo et al. ..... 399/404
6,473,590 B2 10/2002 Matsumoto et al. ..... 399/404
6,505,017 B2 1/2003 Fujii et al. ..... 399/82

(Continued)

FOREIGN PATENT DOCUMENTS

JP 2000-211802 8/2000

(Continued)

OTHER PUBLICATIONS

Japanese Office Action, dated Dec. 11, 2008, issued in Japanese Patent Application No. 2004-085512 and partial English Translation.

*Primary Examiner*—Daniel J Colilla
*Assistant Examiner*—Matthew G Marini
(74) *Attorney, Agent, or Firm*—Fitzpatrick, Cella, Harper & Scinto

(57) ABSTRACT

A punching apparatus having a punching member which effects punching on a sheet, and a driving mechanism which moves the punching member in a sheet width direction intersecting with a sheet conveying direction. On the basis of the difference between the position of a current sheet and the position of a next sheet succeeding thereto detected by a detecting sensor which detects the position of each conveyed sheet in the sheet width direction, at a position upstream of the punching member, the punching member is moved by the driving mechanism along the sheet width direction from a punching position for the current sheet to a punching position for the next sheet.

11 Claims, 11 Drawing Sheets

U.S. PATENT DOCUMENTS

| | | | | |
|---|---|---|---|---|
| 6,869,010 | B2 * | 3/2005 | Morson | 234/50 |
| 6,871,042 | B2 | 3/2005 | Nemura et al. | 399/389 |
| 6,904,261 | B2 | 6/2005 | Fujii et al. | 399/382 |
| 6,907,806 | B1 * | 6/2005 | Okamoto et al. | 83/76.8 |
| 2002/0191997 | A1 | 12/2002 | Matsumoto et al. | 399/404 |
| 2003/0118384 | A1 | 6/2003 | Moriyama | 399/382 |
| 2004/0257601 | A1 | 12/2004 | Tomiyasu et al. | 358/1.9 |
| 2005/0155474 | A1 | 7/2005 | Okamoto et al. | 83/76.8 |
| 2005/0185999 | A1 | 8/2005 | Matsumoto et al. | 399/391 |

FOREIGN PATENT DOCUMENTS

| | | | |
|---|---|---|---|
| JP | 2001-97638 | | 4/2001 |
| JP | 2001097638 A | * | 4/2001 |

* cited by examiner

IMAGE FORMING SYSTEM, SHEET TREATING APPARATUS, IMAGE FORMING APPARATUS, CONTROL PROGRAM AND STORAGE MEDIUM

BACKGROUND OF THE INVENTION

1. Field of the Invention

The invention relates to an image forming system, a sheet treating apparatus, an image forming apparatus, a control program and a storage medium.

2. Description of the Related Art

Generally, a sheet treating apparatus connected to an image forming apparatus is used for the punching process to a sheet having an image formed thereon by the image forming apparatus. In this sheet treating apparatus, a sheet discharged from the image forming apparatus is conveyed to a punch unit along a predetermined conveying path, and punching is effected on the sheet by this punch unit. When punching is to be effected by the punch unit, use is made of a method of once stopping the conveyance of the sheet and effecting punching on the sheet, or a method of effecting punching while conveying the sheet. In any of these methods, at a position on this side of the punch unit, a side edge portion of the sheet is detected by a sensor or the like, and the widthwise positioning of the punch unit is effected.

As this positioning method, there is, for example, a method of detecting the side edge portion of the sheet, and thereafter moving the punch unit to a position conforming thereto, and effecting punching. Also, the relative position of the sensor and the punch unit is predetermined in accordance with the size of the sheet, and the sensor and the punch unit are constructed integrally with each other, and there is a method of effecting punching at the timing whereat the sensor has detected the side edge portion of the sheet.

Here, during the conveyance of the sheet from the sheet supplying cassette of the image forming apparatus to the punch unit of the sheet treating apparatus via the image forming apparatus, or by a change or the like of the sheet supplying cassette, the sheet may sometimes deviate from a reference position into a sheet width direction (a direction orthogonal to the conveying direction of the sheet). Consequently, the position of the current sheet and the position of the next sheet may sometimes deviate with respect to the sheet width direction. In order to cope with this positional deviation of the sheet in the sheet width direction, there is an apparatus which detects the side edge portion of each sheet, and moves the punch unit in the widthwise direction of the sheet to thereby effect the positional adjustment of the punch unit in the sheet width direction (see Japanese Patent Application Laid-open No. 2001-97638). In order to effect such positional adjustment, the sensor and the punch unit are once retracted to a position separate from the side edge of the sheet, and start to move from the retracted position in order to detect the side edge portion of the sheet.

However, the above-described positional adjustment of the punch unit in the sheet width direction for coping with the positional deviation of the sheet in the sheet width direction is effected each time a sheet is carried into the punch unit and therefore, it is limited in further improving the productivity of the punching process, and further is limited in improving the throughput of an entire image forming system including the sheet treating apparatus.

SUMMARY OF THE INVENTION

It is the object of the present invention to provide an image forming system, a sheet treating apparatus, an image forming apparatus, a control program and a storage medium which can shorten the time required for the adjustment of a punching position in a sheet width direction, and can realize a higher speed punching process.

In order to achieve the above object, the image forming system of the present invention has:

an image forming unit which forms an image on a sheet;

a punching member which effects punching on the sheet on which an image has been formed by the image forming unit;

a detecting sensor which detects the position of each conveyed sheet in a sheet width direction intersecting with a sheet conveying direction, at a position upstream of the punching member; and a driving mechanism which moves the punch member in the sheet width direction;

wherein on the basis of the difference between the position of the current sheet and the position of a next sheet succeeding thereto detected by the detecting sensor, the punching member is moved by the driving mechanism so as to move along the sheet width direction from a punching position for a current sheet to a punching position for the next sheet.

Also, the punching apparatus of the present invention has:

a sheet conveying path on which a sheet is conveyed;

a punching member which effects punching on the sheet conveyed on the sheet conveying path;

a detecting sensor which detects the position of each conveyed sheet in a sheet width direction intersecting with a sheet conveying direction at a position upstream of the punching member in the sheet conveying path; and a driving mechanism which moves the punching member in the sheet width direction;

wherein on the basis of the difference between the position of a current sheet and the position of a next sheet succeeding thereto detected by the detecting sensor, the punching member is moved by the driving mechanism so as to move along the sheet width direction from a punching position for the current sheet to a punching position for the next sheet.

Also, a sheet treating apparatus connected to an image forming apparatus having a detecting sensor which detects the position of each conveyed sheet in a sheet width direction intersecting with a sheet conveying direction has:

a punching member which effects punching on a sheet discharged from the image forming apparatus; and a driving mechanism which moves the punching member in the sheet width direction;

wherein on the basis of the difference between the position of a current sheet and the position of a next sheet succeeding thereto detected by the detecting sensor, the punching member is moved along the sheet width direction from a punching position for the current sheet to the punching position for the next sheet by the driving mechanism.

Also, an image forming apparatus to which can be connected a sheet treating apparatus having a punching member which effects punching on a sheet and a controller which controls the punching position of the punching member for each sheet has:

a sheet feeding member which feeds the sheet;

an image forming unit which forms an image on the sheet fed by the sheet feeding member;

a detecting sensor which is provided between the sheet feeding member and the image forming unit and detects the position of each conveyed sheet in a sheet width direction intersecting with a sheet conveying direction; and a transmitter which transmits the positional information of each sheet detected by the detecting sensor to the sheet treating apparatus as a variable for controlling the punching position of the punching member by the controller of the sheet treating apparatus.

Also, a control program for controlling a sheet treating apparatus having a punching member which effects punching on a sheet, and a driving mechanism which moves the punching member in a sheet width direction intersecting with a sheet conveying direction on the basis of an output from a detecting sensor which detects the position of each conveyed sheet in the sheet width direction has:

an inputting module which inputs the position of each sheet detected by the detecting sensor; and a controlling module which controls the driving mechanism so as to move the punching member along the sheet width direction from a punching position for a current sheet to a punching position for a next sheet succeeding thereto, on the basis of the difference between the position of the current sheet and the position of the next sheet inputted by the inputting module.

Also, a control program for controlling an image forming system provided with an image forming unit which forms an image on a sheet, a punching member which effects punching on the sheet on which an image has been formed by the image forming unit, a detecting sensor which detects the position of each conveyed sheet in a sheet width direction intersecting with a sheet conveying direction, at a position upstream of the punching member, and a driving mechanism which moves the punching member in the sheet width direction has:

an inputting module which inputs the position of each sheet detected by the detecting sensor; and a controlling module which controls the driving mechanism so as to move the punching member along the sheet width direction from a punching position for a current sheet to a punching position for a next sheet succeeding thereto, on the basis of the difference between the position of the current sheet and the position of the next sheet inputted by the inputting module.

DESCRIPTION OF THE PREFERRED EMBODIMENTS

Some embodiments of the present invention will hereinafter be described with reference to the drawings.

Figure 1:
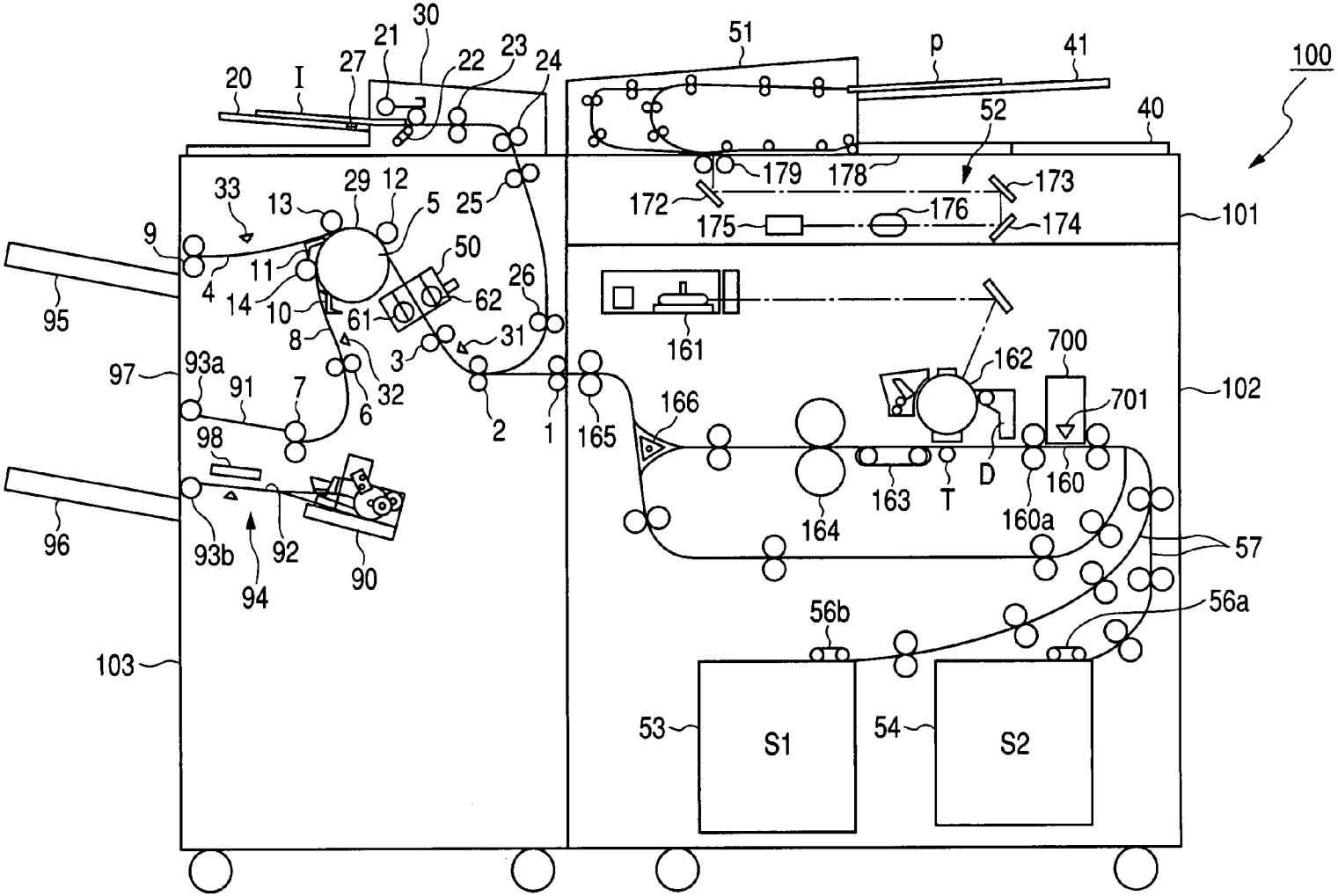
FIG. 1 typically shows the construction of an image forming system according to an embodiment of the present invention.
Figure 2:
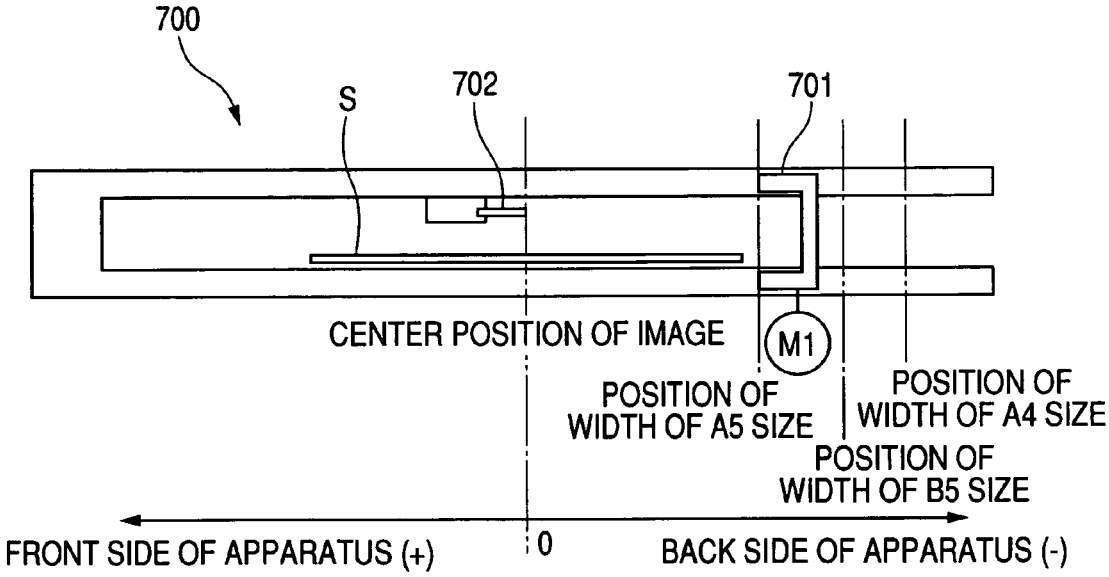
FIG. 2 is a cross-sectional view of the construction of the side edge detecting portion 700 of FIG. 1 perpendicular to a sheet conveying portion as it is seen from the left direction of a main body.
Figure 3:
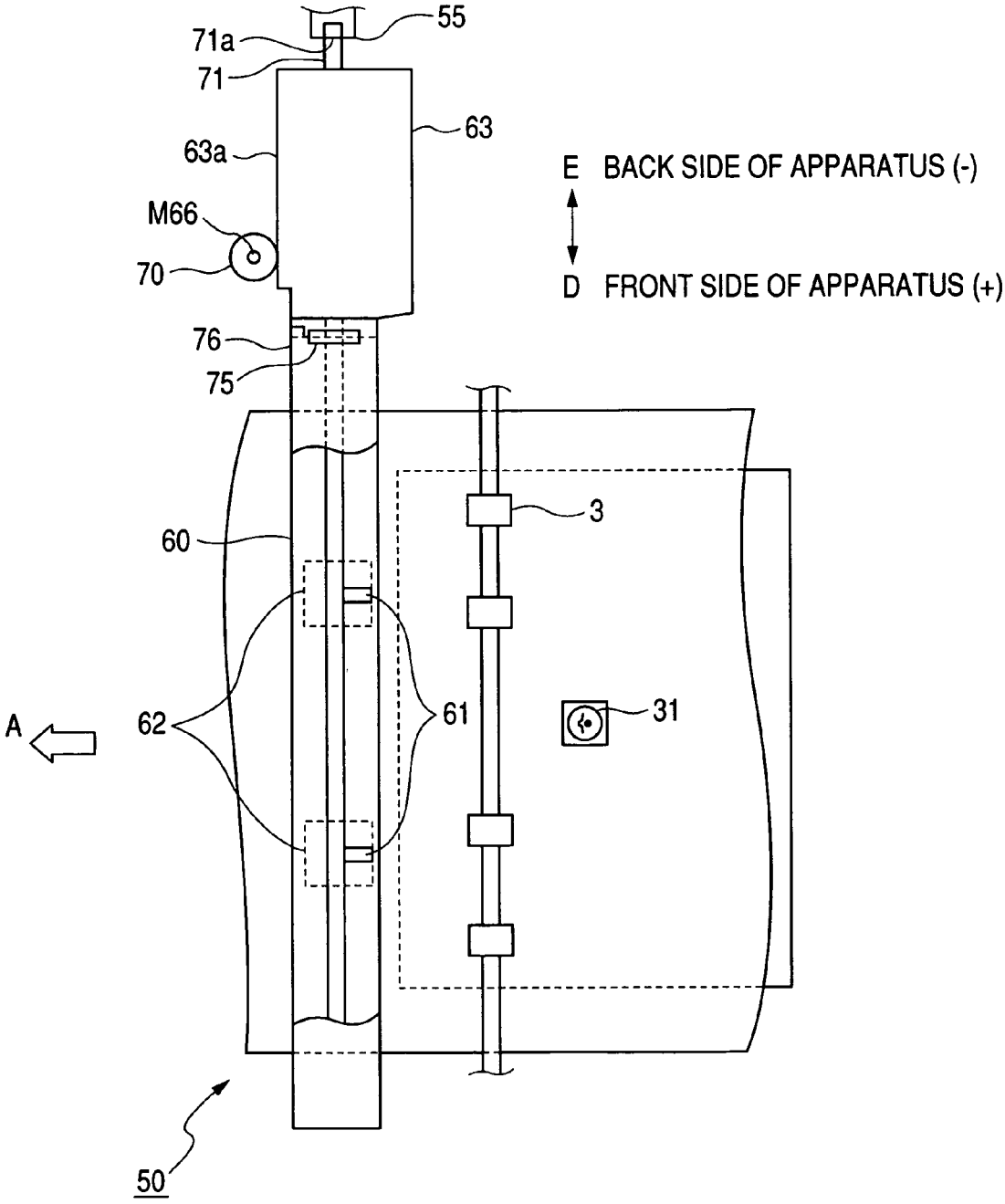
FIG. 3 is a plan view typically showing the construction of the punch unit 50 of FIG. 1.
Figure 4:
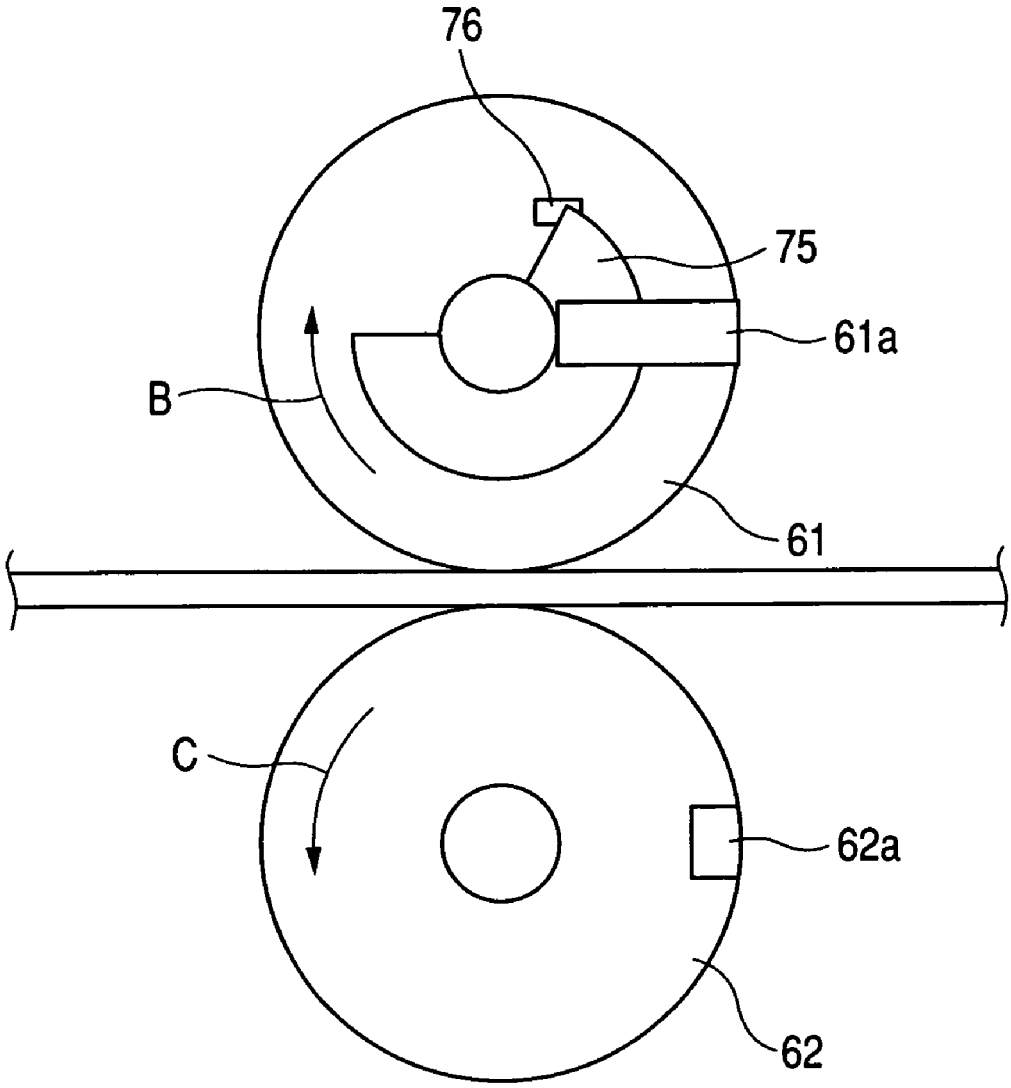
FIG. 4 is a longitudinal cross-sectional view typically showing a state in which the punch 61 of the punch unit 50 of FIG. 3 is at a home position (HP).
Figure 5:
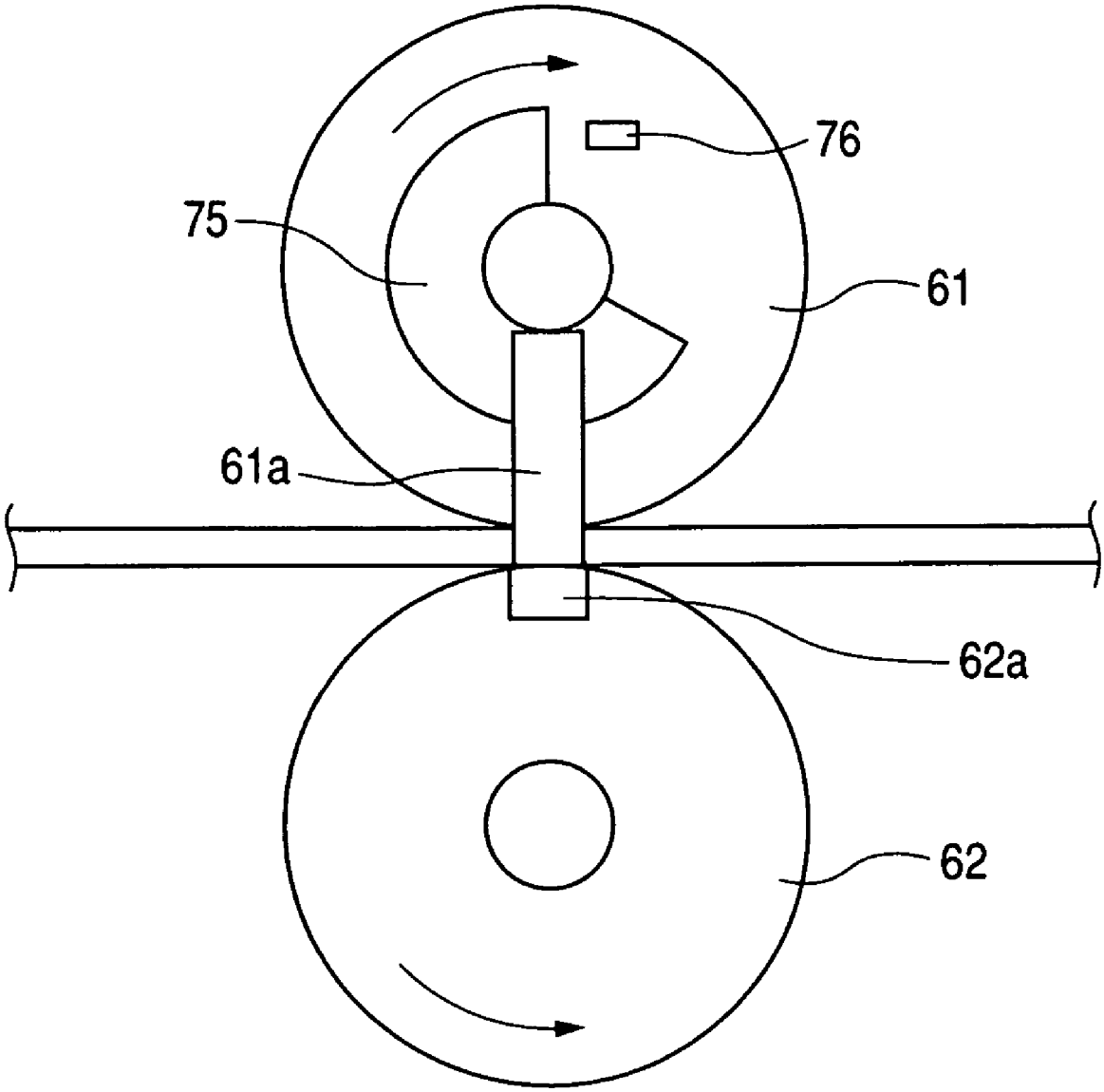
FIG. 5 is a longitudinal cross-sectional view typically showing a state in which the punch 61 and dies 62 of FIG. 4 are punching.
Figure 6:
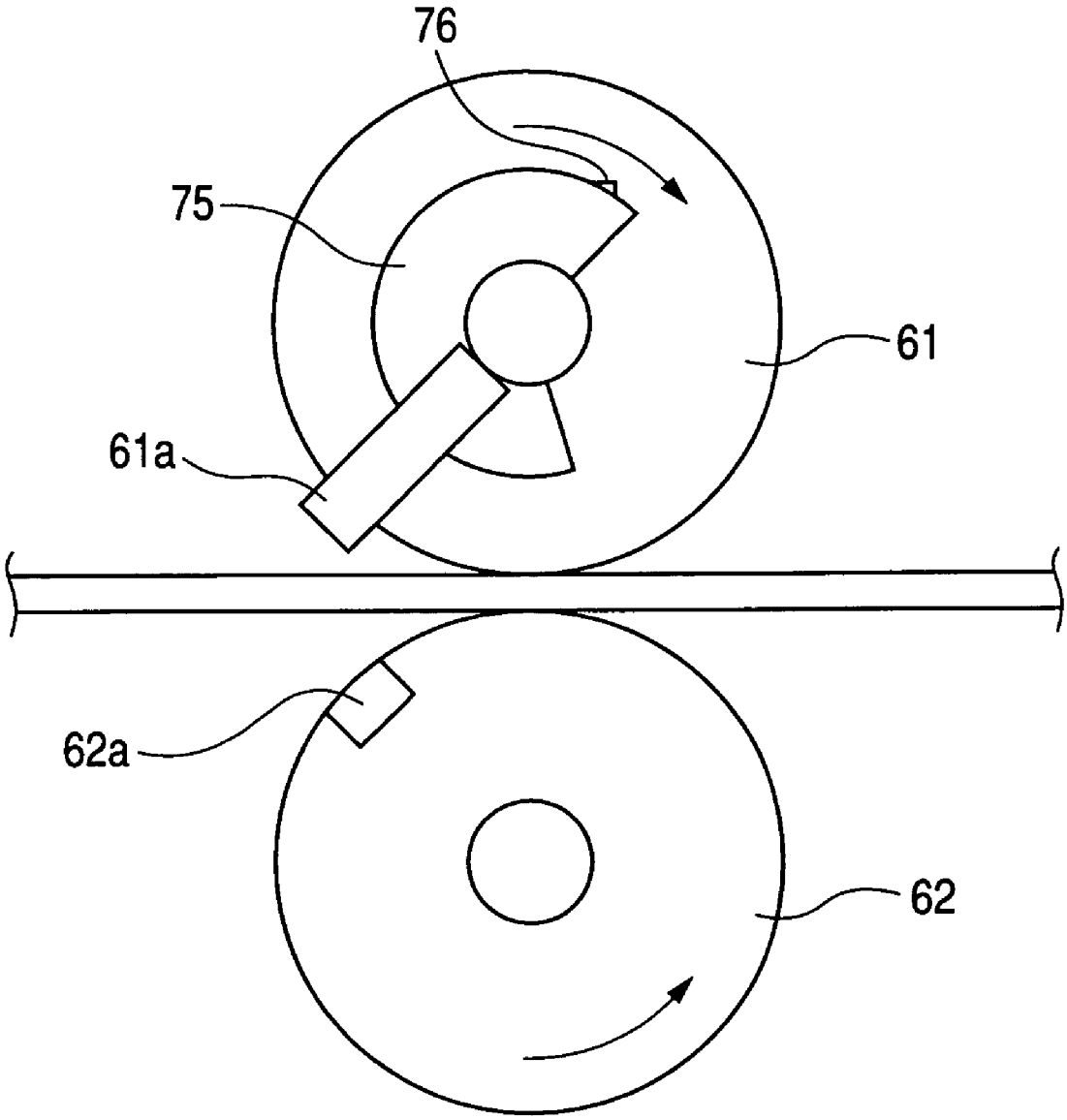
FIG. 6 is a longitudinal cross-sectional view typically showing a state in which the punch 61 and dies 62 of FIG. 4 have completed punching.

FIG. 1 typically shows the construction of an image forming system according to an embodiment of the present invention, FIG. 2 is a cross-sectional view of the construction of the side edge detecting portion 700 of FIG. 1 perpendicular to a sheet conveying direction as it is seen from the left direction of a main body, FIG. 3 is a plan view typically showing the construction of the punch unit 50 of FIG. 1, FIG. 4 is a longitudinal cross-sectional view typically showing a state in which the punch 61 of the punch unit 50 of FIG. 3 is at a home position (HP), FIG. 5 is a longitudinal cross-sectional view typically showing a state in which the punch 61 and dies 62 of FIG. 4 are punching, and FIG. 6 is a longitudinal cross-sectional view typically showing a state in which the punch 61 and dies 62 of FIG. 4 have completed punching.

The image forming system 100, as shown in FIG. 1, is provided with an original reading apparatus 101, an image forming apparatus main body 102 and a sheet treating apparatus 103.

The original reading apparatus 101 has an automatic original feeding portion 51 which feeds an original P set on an original tray 41 to an original reading position on an original glass stand (platen glass, i.e., an original plate) 178, and thereafter conveys it to a sheet discharging position, and a scanner portion 52 for reading an image on the original P conveyed to the original reading position on the original glass stand 178. The scanner portion 52 has a lamp 179 for illuminating the original P conveyed to the above-mentioned original reading position, reflecting mirrors 172, 173, 174, a lens 176 and a line sensor (hereinafter referred to as the CCD) 175. Reflected light from the original P illuminated by the lamp 179 is imaged on the CCD 175 through the intermediary of the mirrors 172, 173, 174 and the lens 176. The CCD 175 converts the imaged optical image into an electrical signal. This electrical signal is subjected to predetermined processing and is converted into image information which in turn is inputted to a laser scanner 161 which will be described later.

The image forming apparatus main body 102 has a plurality of sheet containing portions 53 and 54 on which sheets S (S1, S2) of different sizes are stacked, and a plurality of sheet feeding portions 56*a* and 56*b* for feeding the sheets S stacked thereon. The sheet S fed from one of the sheet containing portions 53 and 54 through the sheet feeding portions 56*a* and 56*b* is conveyed toward a photosensitive member 162 through a sheet feeding path 57 and a sheet conveying path 160. At this time, the fed sheet S has its leading edge rammed against a pair of registration rollers 160*a* provided at a location on this side of the photosensitive member 162 on the sheet conveying path 160, and is once stopped on the sheet conveying path 160. This ramming of the sheet S against the pair of registration rollers 160*a* is for correcting the skew feed of the sheet S. The sheet S is then fed out toward the photosensitive member 162 by the pair of registration rollers 160*a* in timed relationship with the start of image formation on the photosensitive member 162.

A laser scanner 161 scans a laser beam onto the photosensitive member 162 in a main scanning direction on the basis of image information from the scanner portion 52. Thereby, an electrostatic latent image is formed on the surface of the photosensitive member 162. This electrostatic latent image is visualized as a toner image by a toner supplied from a developing device D, and this toner image is transferred to the sheet S fed from corresponding one of the sheet containing portions 53 and 54, by a transferring portion T. The sheet S to which the toner image has been transferred is conveyed to a fixing device 164 through a conveying belt 163. The fixing device 164 heats and pressurizes the toner image on the sheet S to thereby fix the toner image on the sheet S. The sheet S on which the toner image has been fixed is conveyed to the sheet treating apparatus 103 through a changeover flapper 166 and a pair of discharge rollers 165.

Also, when a two-side mode is set, the sheet S on one side of which an image has been formed is reversed by the reversing operation of the changeover flapper 166 and the pair of discharge rollers 165 so that the image-formed side may become the other side, and is conveyed to a two-side path 240. This sheet S is then conveyed again toward the photosensitive member 162 through the sheet conveying path 160, and a toner image is transferred to the other side of the sheet S. Thereafter, the sheet S is conveyed to the sheet treating apparatus through the intermediary of the conveying belt 163, the fixing device 164, the changeover flapper 166 and the pair of discharge rollers 165.

Also, the original reading apparatus 101 is provided with an operating portion 40 for effecting the setting of the operations of the image forming apparatus main body 102 and the sheet treating apparatus 103, and confirming the contents of the setting. This operating portion 40 has a displaying portion (not shown) for confirming the contents of the setting, a touch panel key (not shown) attached onto the displaying portion for effecting the detailed setting of the image forming operation, the setting of the operation of the sheet treating apparatus 103, etc., and various hard keys (not shown). The various hard keys include ten keys for setting a numerical value such as the number of image-formed sheets, a stop key for stopping the image forming operation, a reset key for resetting to initial setting, a start key for starting the image forming operation, etc.

Also, a side edge detecting portion 700 is provided on the sheet conveying path 160. The side edge detecting portion 700 detects the position of that side edge of each conveyed sheet which is parallel to a sheet conveying direction. The side edge detecting portion 700 also detects the deviation amount of each fed sheet in the width direction thereof (a direction intersecting with the sheet conveying direction) from a reference position (hereinafter referred to as the width direction deviation amount). The side edge detecting portion 700 is disposed at a location on this side of the pair of registration rollers 160 on the sheet conveying path 60. In the present image forming system, the operation of detecting the side edge of the sheet S is performed before the image forming operation onto the sheet S by the use of the side edge detecting portion 700. This side edge detecting operation is performed before the image forming operation onto a first side when the job is a one-side mode, and is performed before the image forming operation onto a second side when the job is a two-side mode. This side edge detecting operation is controlled by a recording sheet feed controlling portion 202 which will be described later.

The side edge detecting portion 700, as shown in FIG. 2, has a side edge detecting sensor 701 comprising a photosensor. The side edge detecting sensor 701 is supported for movement in a direction orthogonal to the conveying direction of the sheet S, i.e., a sheet width direction (the left to right direction in FIG. 2), and the movement and positioning of the side edge detecting sensor 701 are effected by a stepping motor M1. The positioning of the side edge detecting sensor 701 is effected with the position of a reference plate 702 provided at the center position of image as the reference. Here, the center position of image is the center position in the sheet width direction in image formation which is determined in design. Also, the sheet S has been conveyed from a two-side path 240 or one of the sheet containing portions 53 and 54, and the conveying direction thereof is a direction from the front side to the back side of FIG. 2.

The side edge detecting sensor 701 is moved to a position for detecting the above-described reference plate 702 by an initializing operation. The position at which the side edge detecting sensor 701 has detected the reference plate 702 is regarded as the center position of image. After this initializing operation, the side edge detecting sensor 701 is moved, and is positioned at a reference position corresponding to the width size (the size in the sheet width direction) of the fed sheet S. Then, the side edge detecting sensor 701 stands by at the corresponding reference position. This reference position is a position determined in accordance with the width size of the sheet S fed with the position of the reference plate 702 as the reference, and in the present embodiment, there are shown reference positions corresponding to the width sizes of A5, B5 and A4 sheets.

The sheet S fed from corresponding one of the sheet containing portions 53 and 54 is once stopped on the sheet conveying path 160 by the pair of registration rollers 160*a*, and thereafter is conveyed toward the photosensitive member 162 in timed relationship with the start of image formation. During the stoppage of this fed sheet S, there is performed the operation of detecting the edge portion of the sheet S in the width direction thereof by the side edge detecting sensor 701 standing by at the reference position corresponding to the width size of the fed sheet S.

When the side edge detecting sensor 701 standing by at the corresponding reference position cannot detect the edge portion of the sheet S in the width direction thereof, the side edge detecting sensor 701 is moved toward the center position of image until it detects the edge portion of the sheet S in the width direction thereof. Then, the amount of movement of the side edge detecting sensor 701 from the above-described reference position to a position at which it detects the edge portion of the sheet S in the width direction thereof is found as the deviation amount (width direction deviation amount) of the fed sheet S from the reference position, from the amount of rotation (or driving pulse number) or the like of the stepping motor M1.

Also, when the side edge detecting sensor 701 standing by at the corresponding reference position could detect a portion (including the edge portion in the sheet width direction) of the sheet S, the side edge detecting sensor 701 is once moved away from the center position of image, and is stopped at a position whereat it does not detect the sheet S. Then, the side edge detecting sensor 701 is again moved from the position at which it does not detect the sheet S toward the center position of image until it detects the edge portion of the sheet S in the width direction thereof. Then, the deviation amount (width direction deviation amount) of the fed sheet S from the corresponding reference position is calculated from the amount of movement of the side edge detecting sensor 701 resulting from the above-described operation.

Here, the above-described width direction deviation amount is calculated with the reference position corresponding to the width size of the sheet S as 0, and with the direction toward right side of FIG. 2 (the back side of the apparatus as the negative (−) side, and the direction toward the left side of FIG. 2 (this side of the apparatus) as the positive (+) side. When for example, it has been detected that the sheet S deviates by 1 mm from the corresponding reference position to the back side of the apparatus, a value of "− (minus) 1" is regarded as the width direction deviation amount.

In accordance with the width direction deviation amount found in this manner, the application timing of the laser beam from the laser scanner 161 to the photosensitive member 162 is changed, and the image forming start position for the sheet S in the main scanning direction is corrected. Also, the above-described width direction deviation amount is transmitted to the sheet treating apparatus controlling portion 205 (FIG. 7) which will be described later, and by the sheet treating apparatus controlling portion 205, the adjustment of the punching position (operating position) of the punch unit 50 for the sheet S is effected in accordance with the above-described width direction deviation amount. The details of this adjustment of the punching position will be described later.

The sheet treating apparatus 103, as shown in FIG. 1, carries thereon an inserting apparatus 30 for supplying insert sheets I. The inserting apparatus 30 has an insert sheet containing portion 20 on which the insert sheets I to be inserted are set, a sheet feeding roller 21 for feeding the set insert sheets I, a separating roller 22 for separating the fed insert sheets I, pairs of conveying rollers 23 and 24 for conveying the fed insert sheets I toward the interior of the sheet treating apparatus 103, and an insert sheet setting detecting sensor 27 for detecting whether the insert sheets I are set on the insert sheet containing portion 20.

Also, the sheet treating apparatus 103 has two pairs of conveying rollers 25 and 26 for conveying the insert sheets I fed from the inserting apparatus 30 into the sheet treating apparatus, and a pair of entrance rollers 1 for conveying the sheet S discharged from the image forming apparatus main body 102 into the sheet treating apparatus. The sheet S conveyed in through the pair of entrance rollers 1 or the insert sheet I conveyed in through the pairs of conveying rollers 25 and 26 is conveyed toward the punch unit 50 through pairs of conveying rollers 2 and 3. A sheet detecting sensor 31 for detecting the passage of the sheet S or the insert sheet I is provided between the pairs of conveying rollers 2 and 3. The punch unit 50 is a unit for effecting punching on the vicinity of the trailing edge of the sheet S or the insert sheet I conveyed thereto. The details of the construction of this punch unit 50 will be described later.

A buffer roller 5 is disposed downstream of the punch unit 50, and on the outer periphery thereof, there is formed a buffer path 29 for temporarily storing the sheet S or the insert sheet I thereon. Also, around this buffer roller 5, there are disposed urging runners 12, 13 and 14 for urging the sheet S against the peripheral surface of the buffer roller 5 and conveying it. Also, around the buffer roller 5, there are disposed a first changeover flapper 11 and a second changeover flapper 10. The first changeover flapper 11 is a flapper for selectively changing over the conveying path of the sheet S or the insert sheet I to a non-sorting path 4 or a sorting path 8. The second changeover flapper 10 is a flapper for selectively changing over the conveying path of the sheet S or the insert sheet I to a sorting path 8 or a buffer path 29.

In the non-sorting path 4, there is provided a sheet detecting sensor 33 for detecting the sheet S or the insert sheet I. The sheet S or the insert sheet I directed to the non-sorting path 4 is discharged onto a sample tray 95 through a pair of discharge rollers 9.

In the sorting path 8, there is provided a sheet detecting sensor 32 for detecting the sheet S or the insert sheet I. The sheet S or the insert sheet I directed to the sorting path 8 is directed to a treatment tray unit 94 through pairs of conveying rollers 6 and 7. The treatment tray unit 94 has a treatment tray 92 on which the sheets including the sheet S and the insert sheet I are temporarily stacked in a bundle shape, an aligning plate 98 for aligning the sheet bundle stacked on the treatment tray 92, and a staple unit 90 for stapling the sheet bundle stacked on the treatment tray 92.

The sheet bundle stacked on the treatment tray 92 is discharged onto a stacking tray 96 by a bundle discharging roller. The bundle discharging roller is comprised of an upper roller 93*a* supported by a rockable guide 91, and a lower roller 93*b* disposed on the discharge end side of the treatment tray 92. During the discharge of the sheet bundle, the rockable guide 91 is rocked so that the upper roller 93*a* may be moved down toward the lower roller 93*b*, and the upper roller 93*a* cooperates with the lower roller 93*b* to discharge the sheet bundle on the treatment tray 92 onto the stacking tray 96. Here, the sheet bundle is discharged onto the stacking tray 96 with its trailing edge (the trailing edge with respect to a bundle discharging direction) rammed against a bundle stacking guide 97. Thereby, the alignment of the sheet bundle discharged onto the stacking tray 96 is accomplished. Likewise, the sheets stacked on the sample tray 95 are stacked with their trailing edge rammed against the bundle stacking guide 97. In the present embodiment, the bundle stacking guide 97 is designed to serve also as the outer packaging of the sheet treating apparatus 103.

The punch unit 50, as shown in FIG. 3, has a punch portion 60. The punch portion 60 is provided with a punch 61 (punch member) and dies 62, and the punch 61 and the dies 62 are secured to corresponding rotary shafts, respectively. The rotary shafts of the punch 61 and the dies 62 are supported by a casing 63, and the driving force of a punch driving motor (not shown) is transmitted to the respective rotary shafts through a gear mechanism (not shown). The punch 61 and the dies 62 are rotated in synchronism with each other in directions indicated by arrows B and C, respectively, in FIG. 4.

A driving mechanism which moves a punch unit 50 in a sheet width direction intersecting with a sheet conveying direction will be described below. A rack gear 63*a* is formed integrally with the casing 63, and the rack gear 63*a* is brought into mesh engagement with a pinion gear 70 provided on a punch moving motor 66. Thereby, the punch portion 60 is movable in a direction orthogonal to the conveying direction of the sheet S indicated by arrow A, i.e., a direction indicated by arrow D (this side of the apparatus), or a direction indicated by arrow E (the back side of the apparatus). The casing 63 has mounted thereon an initial position detecting sensor 71 for detecting the initial position (the initial position in the direction indicated by arrow D or E), i.e., home position (hereinafter referred to as the HP) of the punch portion 60, and this initial position detecting sensor 71 is provided with a light receiving portion 71*a* for detecting a punch slide home position member (hereinafter referred to as the HP member) 55 provided on the main body of the sheet treating apparatus 103. It is to be understood here that the HP of the punch portion 60 is several millimeters short of a position corresponding to a reference position of the reference positions of the side edge detecting sensor 701 which is farthest from the center position of image.

The punch portion 60 is moved from its HP to a standby position corresponding to the sheet S when a punch mode is set. Then, as will be described later, the positional adjustment of the punch portion 60 in the sheet width direction is effected, as required, and after the completion of this positional adjustment, the punch 61 and the dies 62 are driven at predetermined timing, and an aperture is formed at a predetermined location of the sheet S.

The punch 61 and the dies 62 are normally at such initial positions as shown in FIG. 3. The above-mentioned punch driving motor is driven at predetermined timing after the sheet detecting sensor (sheet detecting means) 31 has detected the trailing edge of the sheet S, and the punch 61 and the dies 62 are rotated in the directions of arrows B and C, respectively, as shown in FIG. 4. Then, as shown in FIG. 5, the punching member 61*a* of the punch 61 and a die aperture 62*a* formed in the die 62 mesh with each other, whereby an aperture is formed in the sheet S being conveyed. Here, the rotating speeds of the punch 61 and the dies 62 are made equal to the rotating speed of the conveying roller 3, whereby it becomes possible to punch the sheet S being conveyed. After the punching of the sheet S, as shown in FIG. 6, the meshing engagement between the punching member 61*a* of the punch 61 and the die aperture 62*a* of the dies 62 is released by the rotation of the punch 61 and the dies 62.

A flag 75 is secured to the rotary shaft of the punch 61, as shown in FIGS. 3 and 4, and this flag 75 is detected by a punch position detecting sensor 76, whereby the rotation of the punch 61 is detected.

Figure 7:
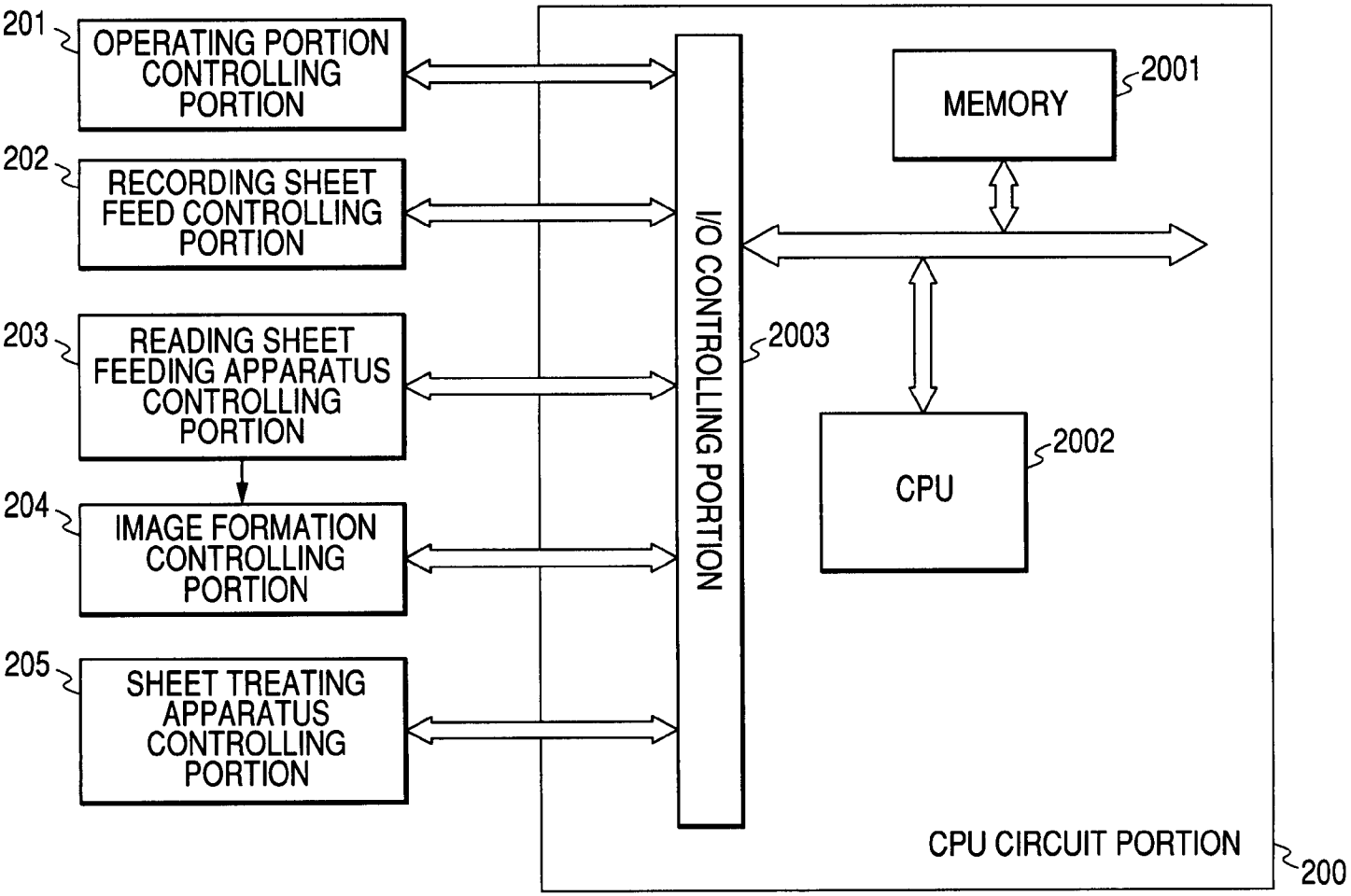
FIG. 7 is a block diagram showing a controlling construction in the image forming system 100 of FIG. 1.

A controlling-construction in the present image forming system 100 will now be described with reference to FIG. 7. FIG. 7 is a block diagram showing the controlling construction in the image forming system 100 of FIG. 1.

As shown in FIG. 7, a CPU circuit portion 200 is carried on the image forming apparatus main body 102 of the image forming system 100. The CPU circuit portion 200 includes a CPU 2002, a memory 2001 and an I/O controlling portion 2003. The CPU 2002 effects calculation and processing in accordance with a predetermined program and data stored in the memory 2001, in order to control the entire system. The memory 2001 includes a ROM storing a program and predetermined data therein, a RAM temporarily storing therein data obtained in accordance with various processings, an IC card and a Floppy (registered trademark) disk or the like. The I/O controlling portion 2003 is an interface for transmitting and controlling input and output signals.

The CPU circuit portion 200 gives a signal including operating instructions to an operating portion controlling portion 201, a recording sheet feed controlling portion 202, a reading sheet feeding apparatus controlling portion 203, an image formation controlling portion 204 and a sheet treating apparatus controlling portion 205 through the I/O controlling portion 2003.

The operation controlling portion 201 outputs a key signal corresponding to the operation of each key of the operating portion 40 to the CPU circuit portion 200, and also controls so that corresponding information may be displayed on the displaying portion of the operating portion 40 on the basis of instructions from the CPU circuit portion 200.

The recording sheet feed controlling portion 202 controls the feeding of the sheets S from the sheet containing portions 53 and 54 of the image forming apparatus main body 102 on the basis of a signal from the CPU circuit portion 150.

The reading sheet feeding apparatus controlling portion 203 controls the feeding of the original by the automatic original feeding portion 51 in the original reading apparatus 101 and the reading of the original by the scanner portion 52 on the basis of a signal from the CPU circuit portion 150, and also controls so that various image treatments for image information obtained by the reading of the original may be effected. These various image treatments are executed in the CPU circuit portion 200. Also, the reading sheet feeding apparatus controlling portion 203 controls the detecting operation of the above-described side edge detecting portion on the basis of a signal from the CPU circuit portion 150.

The image formation controlling portion 204 effects the drive control of the laser scanner 161 in the image forming apparatus main body 102 and the drive control of each block for effecting image formation on the fed sheet S on the basis of a signal from the CPU circuit portion 150. The image formation controlling portion 204 also controls the application timing of the laser beam by the laser scanner 161 in accordance with the width direction deviation amount detected by the above-described side edge detecting portion 700.

The sheet treating apparatus controlling portion 205 is carried on the sheet treating apparatus 103, and effects the exchange of a signal with the CPU circuit portion 150 to thereby effect the drive control of the entire sheet treating apparatus 103.

Each of the operating portion controlling portion 201, the recording sheet feed controlling portion 202, the reading sheet feeding apparatus controlling portion 203, the image formation controlling portion 204 and the sheet treating apparatus controlling portion 205 has a CPU (not shown) and memories (not shown) such as a ROM and a RAM, and is designed to execute control and processing in accordance with programs stored in the memories on the basis of a signal from the CPU circuit portion 200.

Description will now be made of the copying operation of the present image forming system 100.

First, originals are set on the automatic original feeding portion 51 of the original reading apparatus 101 by a user, and the setting of the operating mode is effected through the operating portion 40. When the original reading apparatus is then instructed to start copying by the user through the operating portion 40, the originals P are fed one by one from the automatic original feeding portion 51, and the thus fed original P is read by the scanner portion 52. Substantially at the same time, the feeding of the sheet S from the sheet containing portion 53 or 54 storing sheets of designated sizes therein is started. Also, the CPU circuit portion 200 transmits the sheet size of the fed sheet S to the sheet treating apparatus controlling portion 205.

The image information of the original P read by the scanner portion 52 is subjected to image processing corresponding to the user's setting from the operating portion 40, and thereafter is inputted to the laser scanner 161. Then, the charging, exposing, latent image forming, developing transferring, separating and fixing of an ordinary electrophotographic process are effected in the named order, and an image indicated by the above-mentioned image information is formed on the sheet S. Here, during the one-side mode, the above-described side edge detecting operation is performed before the image formation on a first side, and during the two-side mode, the above-described side edge detecting operation is performed before the image formation on a second side, and the application timing of the laser beam to the photosensitive member 162 by the laser scanner 161 is changed in accordance with the width direction deviation amount detected by this side edge detecting operation, whereby the image formation start position for the sheet S in the main scanning direction is corrected. Thereby, the deviation of an image formed on the sheet S in the sheet width direction from the center position of image which is attributable to the deviation of the sheet S in the sheet width direction is eliminated, and as will be described later, the punching position for the sheet S can be obviated from being within the image area on the sheet S. Also, the detected width direction deviation amount of the sheet S is transmitted to the sheet treating apparatus controlling portion 205.

The sheet S on which an image has been formed is conveyed from the image forming apparatus main body 102 to the sheet treating apparatus 103. In the sheet treating apparatus 103, sheet treatments (such as the insertion of the insert sheet I, punching, stapling and sorting) conforming to the user's setting from the operating portion 40 are effected in accordance with the control of the sheet treating apparatus controlling portion 205.

When in the sheet treating apparatus 103, the sheets S are to be stacked on the sample tray 95, the sheets S are discharged via the discharge rollers 9. When the sheets S are to be stacked on the stacking tray 96, the sheets S are discharged from the sheet discharging rollers 7 via the conveying rollers 6, and are discharged onto the treatment tray 92. Here, when the stapling operation is selected by the user through the operating portion 40, the sheet treating apparatus controlling portion 205 drive-controls the staple unit 90 so as to effect the stapling treatment on a bundle of sheets S stacked on the treatment tray 92. Then, the sheet treating apparatus controlling portion 205 operates the aligning plate 98 to thereby align the stacked bundle, and also controls the sorting direction of the bundle stacked on the stacking tray 96. Then, the sheet treating apparatus controlling portion 205 closes the rockable guide 91, and thereafter controls so as to drive bundle discharging rollers 93*a* and 93*b*. Thereby, the sheet bundle in the treatment tray 92 is discharged to and stacked on the stacking tray 96.

Figure 8:
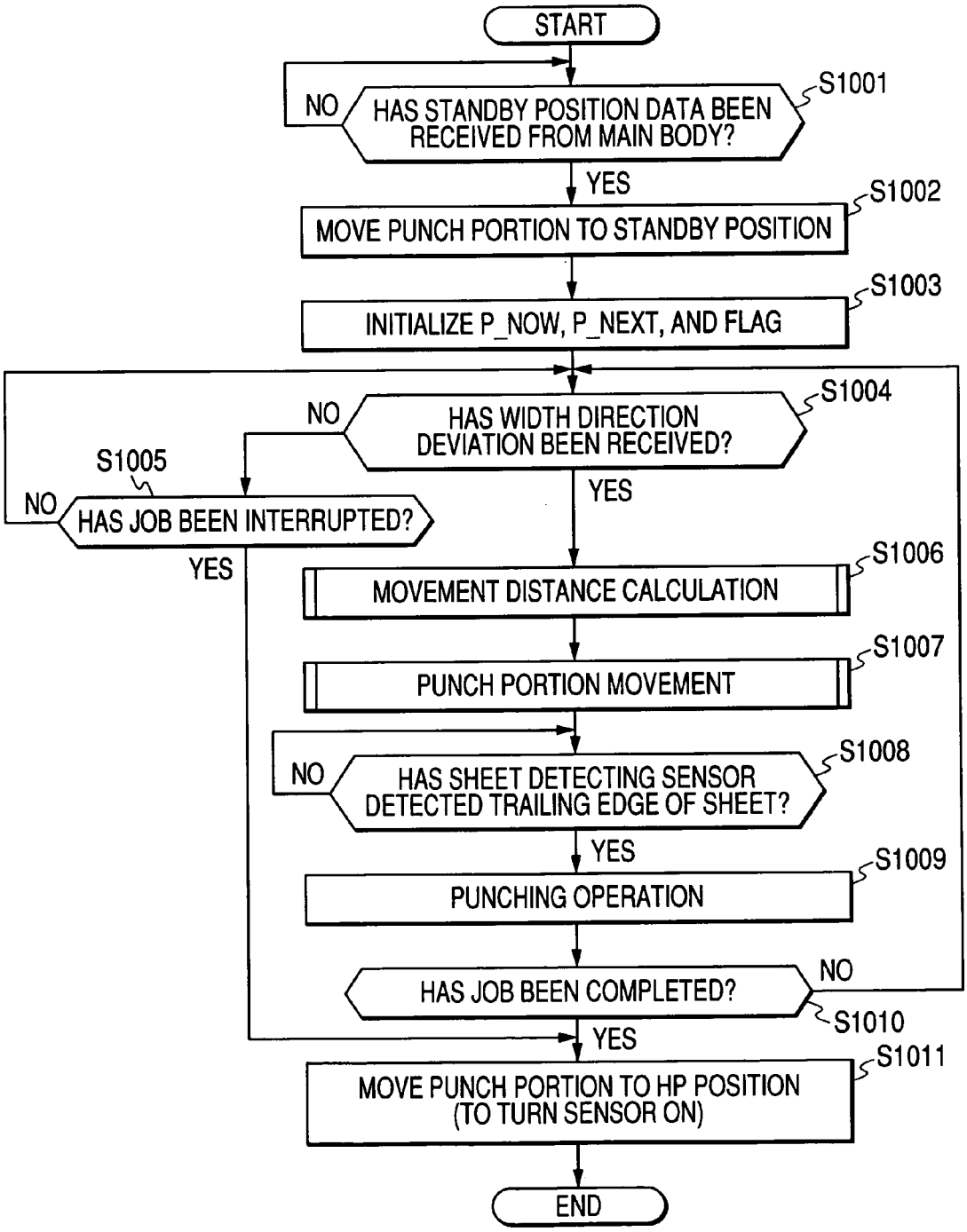
FIG. 8 is a flow chart showing the controlling procedure of a sheet treating apparatus controlling portion 205 in the image forming system 100 of FIG. 1.

The operation when punching is selected as sheet treatment by the user through the operating portion 40 will now be described with reference to FIG. 8. FIG. 8 is a flow chart showing the control procedure of the sheet treating apparatus controlling portion 205 in the image forming system 100 of FIG. 1. The control procedure shown in this flow chart is executed in accordance with a program stored in a memory by the CPU (not shown) of the sheet treating apparatus controlling portion 205.

The sheet treating apparatus controlling portion 205, as shown in FIG. 8, waits for receiving standby position data from the image forming apparatus main body 102 (CPU circuit portion 200) (step S1001). This standby position data is data indicative of the sheet size (lengthwise direction size and width direction size) of the sheet S on which an image is to be formed. The sheet treating apparatus controlling portion 205, when it receives the above-mentioned standby position data, moves the punch portion 60 of the punch unit 50 from the HP to a standby position corresponding to the sheet width direction size of the sheet S on the basis of this standby position data (step S1002). Then, the sheet treating apparatus controlling portion 205 initializes position variable P_NOW and P_NEXT and a flag to 0 (step S1003).

The position variable P_NOW is a variable for representing the distance from the standby position of the punch portion 60 of the punch unit 50 conforming to the width direction size of the sheet S to the current position thereof. The position variable P_NEXT is a variable for representing the distance from the above-mentioned standby position of the punch portion 60 to the next target position thereof, and as will be described later, the width direction deviation amount received from the CPU circuit portion 200 is set as this variable. The flag indicates whether the calculation of the movement distance of the punch portion 60 of the punch unit 50 which will be described later, or the movement itself is being effected, and when 1 is assigned here (the flag is standing), the setting of the received width direction deviation amount to the position variable P_NEXT is inhibited. Thereby, a situation in which in the course of the calculation or the movement, the target position changes and the position of the punch portion 60 of the punch unit 60 cannot be known can be obviated. The position variables P_NOW and P_NEXT and the flag are stored in a memory in the sheet treating apparatus controlling portion 205.

Then, the sheet treating apparatus controlling portion 205 determines whether the width direction deviation amount from the image forming apparatus main body 102 has been received (step S1004), and if the width direction deviation amount has not been received, it determines whether job interrupting information has been received (step S1005). If the job interrupting information is not received, the sheet treating apparatus controlling portion 205 repeats the processes of the step S1004 to the step S1005 until the width direction deviation amount or the job interrupting information is received.

If at the step S1004, the width direction deviation amount is received, the sheet treating apparatus controlling portion 205 calculates the distance by which and the direction in which the punch portion 60 is to be moved, from the current position of the punch portion 60 and the received width direction deviation amount (step S1006). The details of the distance by which and the direction in which the punch portion 60 is to be moved will be described later. Then, the sheet treating apparatus controlling portion 205 moves the punch portion 60 by the distance and in the direction obtained by the above-described calculation (step S1007). The details of this moving process will be described later.

Then, the sheet treating apparatus controlling portion 205 waits for the trailing edge of the sheet S to be detected by the sheet detecting sensor 31 (step S1008), and when the trailing edge of the sheet S is detected by the sheet detecting sensor 31, the sheet treating apparatus controlling portion 205 drives the punch portion 60 after the lapse of a predetermined time thereafter (step S1009). Here, a punch driving motor is driven after the lapse of a predetermined time after the detection of the trailing edge of the sheet S, whereby the punch 61 and the dies 62 are rotatively driven. Thereby, punching is effected on the sheet S.

Then, the sheet treating apparatus controlling portion 205 determines whether the job has been completed (step S1010), and if the job is not completed, it repeats the step S1004 and subsequent steps. In contrast, if the job is completed, the sheet treating apparatus controlling portion 205 moves the punch portion 60 to a position at which the initial position detecting sensor 71 detects the HP member 55 (step S1011), thus completing this process.

When at the step S1005, the job interrupting information is received, the sheet treating apparatus controlling portion 205 judges that the job has been interrupted, and moves the punch portion 60 to the position at which the initial position detecting sensor 71 detects the HP member 55 (step S1011), thus completing this process.

Figure 9:
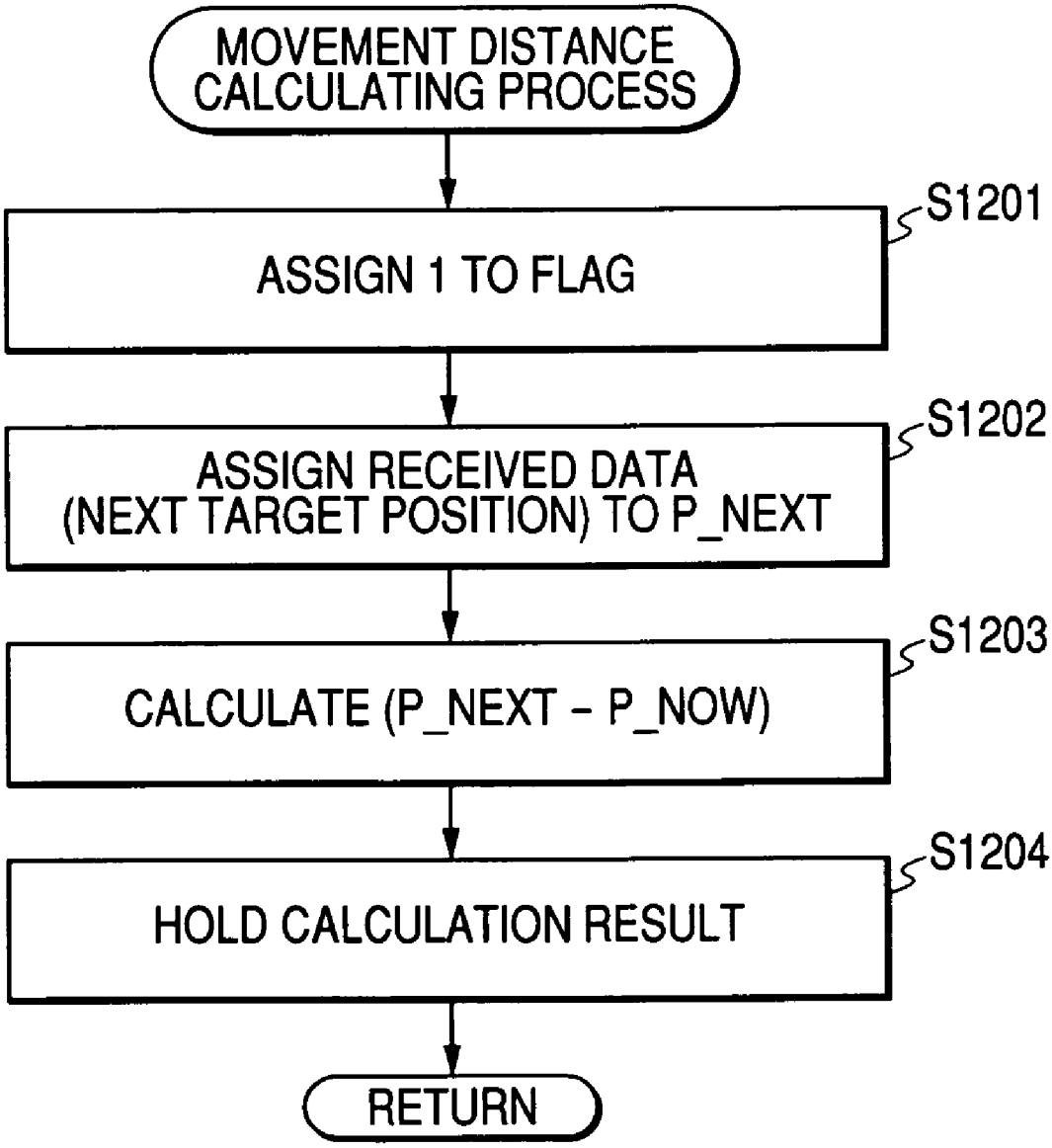
FIG. 9 is a flow chart showing the procedure of movement distance calculation at the step S1006 of FIG. 8.

The calculation of the movement distance of the punch portion 60 will now be described with reference to FIG. 9. FIG. 9 is a flow chart showing the procedure of the movement distance calculation of the step S1006 of FIG. 8.

In the movement distance calculation of the step S1006, the sheet treating apparatus controlling portion 205, as shown in FIG. 9, first assigns 1 to the flag in order to inhibit the intermediate change of the received width direction deviation amount (step S1201). Then, the sheet treating apparatus controlling portion 205 assigns the received width direction deviation amount to the position variable P_NEXT (step S1202).

Then, the sheet treating apparatus controlling portion 205 subtracts the value of the position variable P_NOW from the value of the position variable P_NEXT (step S1203), and holds the result of this subtraction in the memory (step S1204). If the result of this subtraction is a positive value, this result represents that the punch portion 60 is moved by a distance corresponding to that value from the current position of the punch portion 60 to this side of the apparatus (the direction indicated by arrow D in FIG. 3). If the result of this subtraction is a negative value, this result represents that the punch portion 60 is moved by a distance corresponding to that value from the current position of the punch portion 60 to the back side of the apparatus (the direction indicated by arrow E in FIG. 3).

Figure 10:
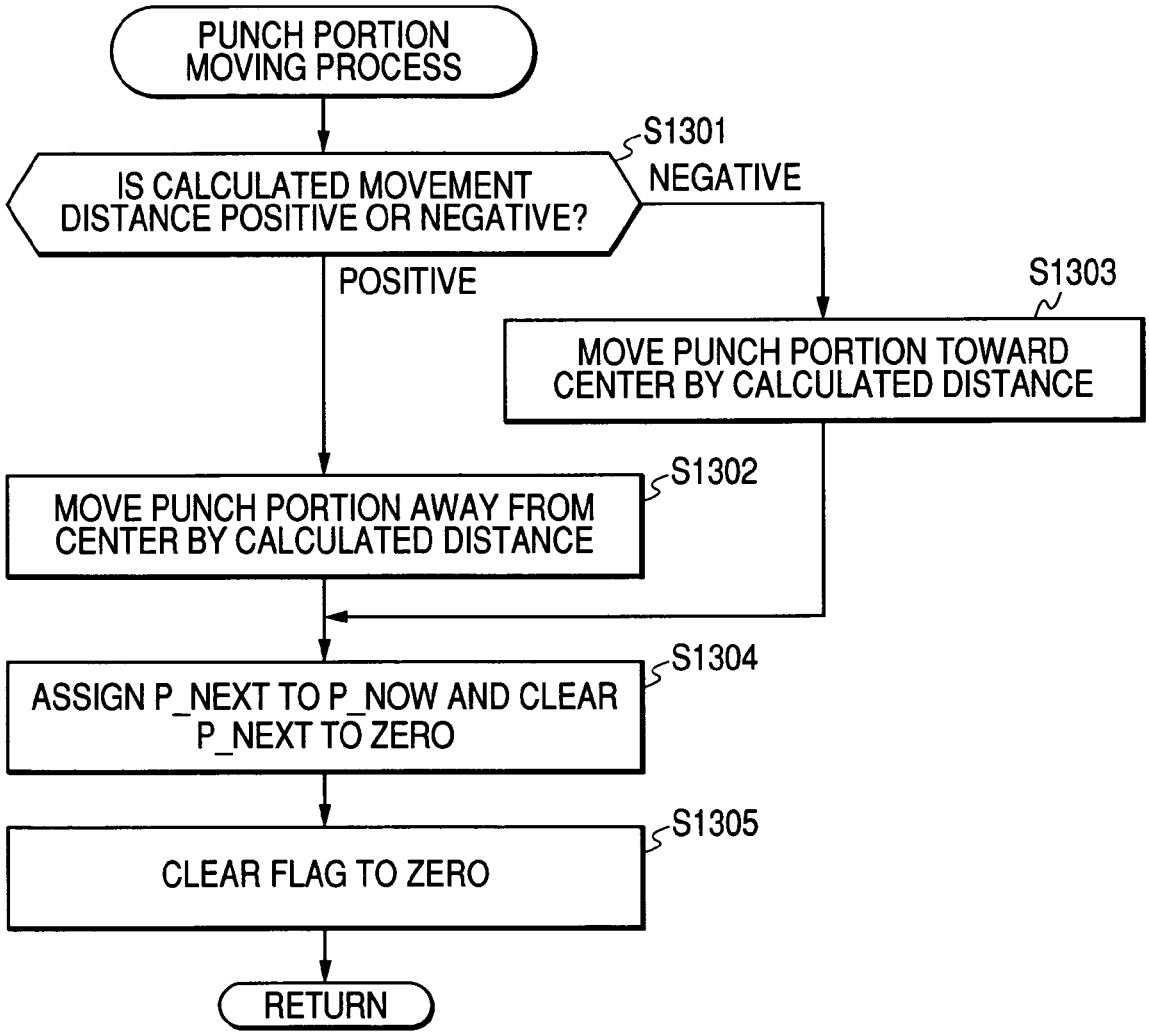
FIG. 10 is a flow chart showing the procedure of punch unit movement at the step S1007 of FIG. 8.

The movement of the punch portion at the step S1007 will now be described with reference to FIG. 10. FIG. 10 is a flow chart showing the procedure of the punch portion movement of the step S1007 of FIG. 8.

In the movement of the punch portion 60, the sheet treating apparatus controlling portion 205, as shown in FIG. 10, discriminates the positive or negative of the calculated movement distance (step S1301). If this movement distance is a positive distance, the position of the position variable P_NEXT (the target position) is on this side of the apparatus (the direction indicated by arrow D in FIG. 3) relative to the position of the position variable P_NOW (the current position) and therefore, the sheet treating apparatus controlling portion 205 drives the punch moving motor M66 to thereby move the punch portion 60 by a distance corresponding to the above-mentioned movement distance from the current position to this side of the apparatus (the direction indicated by arrow D in FIG. 3) (step S1302). Thus, the punching position of the punch portion 60 for the next sheet is adjusted. In contrast, if the movement distance is a negative distance, the position of the position variable P_NEXT (the target position) is on the back side of the apparatus (the direction indicated by arrow E in FIG. 3) relative to the position of the position variable P_NOW (the current position) and therefore, the sheet treating apparatus controlling portion 205 drives the punch moving motor M66 to thereby move the punch portion 60 by a distance corresponding to the above-mentioned movement distance from the current position to the back side of the apparatus (the direction indicated by arrow E in FIG. 3) (step S1303).

When the movement of the punch portion 60 is completed, the sheet treating apparatus controlling portion 205 assigns the value of the position variable P_NEXT to the position variable P_NOW, and clears the value of the position variable P_NEXT to 0 (step S1304). Thus, the position of the punch portion 60 after the movement thereof has been assigned to the position variable P_NOW. Then, the sheet treating apparatus controlling portion 205 clears the flag to 0 (step S1305). Thereby, the setting of the received width direction deviation amount to the position variable P_NEXT is permitted. Then, the sheet treating apparatus controlling portion 205 leaves this process.

When for example, setting for effecting punching on a sheet S of A4 size is selected, in the sheet treating apparatus 103, the punch portion 60 of the punch unit 50 is first moved from the HP to a standby position corresponding to the size of the sheet S of A4 size in the sheet width direction, and the position variables P_NOW and P_NEXT and the flag are initialized to 0. Thereby, the positioning of the punch portion 60 at the standby position in this job is completed.

In the image forming apparatus main body 102, when the first sheet S (the sheet of A4 size) arrives at the side edge detecting portion 700, the side edge detecting operation is performed. When here, it is detected by the side edge detecting operation that the sheet S deviates by 1 mm as a width direction deviation amount from the corresponding standby reference position toward the back side (the right side in FIG. 9) of the apparatus, this width direction deviation amount (−1 mm) is transmitted to the sheet treating apparatus controlling portion 205. In the sheet treating apparatus controlling portion 205, the above-mentioned width direction deviation amount is assigned to the position variable P_NEXT, and the movement distance of the punch portion 60 is calculated.

This movement distance becomes −1 mm (=(−1)−(0)) in accordance with the expression of P_NEXT−P_NOW. Consequently, the punch portion 60 is moved by −1 mm from the current position to the back side of the apparatus (the direction indicated by arrow E in FIG. 3). Then, by the punch portion 60 after the movement thereof, the punching operation is performed on the conveyed first sheet S, and "−1" is assigned to the position variable P_NOW and the position variable P_NEXT is cleared to "0".

Then, the side edge detecting operation for the second sheet S is performed, and assuming that the result thereof represents that this sheet deviates by 2 mm from the standby reference position toward this side (the left side in FIG. 9) of the apparatus, "+2" is assigned to the position variable P_NEXT, and the movement distance of the punch portion 60 becomes +3 mm (=(+2)−(−1)). Consequently, the punch portion 60 is moved by 3 mm from the current position toward this side of the apparatus (the direction indicated by arrow D in FIG. 3). Then, by the punch portion 60 after the movement thereof, the punching operation is performed on the conveyed second sheet S, and "+2" is assigned to the position variable P_NOW, and the position variable P_NEXT is cleared to "0".

As described above, the width direction deviation amount is detected by the side edge detecting operation in the image forming apparatus main body 102, and by the use of this detected width direction deviation amount, it is possible to effect the adjustment of the punching position of the punch portion 60 for the sheet S. Consequently, when the adjustment of the punching position of the punch portion 60 in the sheet width direction is to be effected, the punch portion 60 can be moved by an amount corresponding to the deviation amount relative to the preceding sheet and therefore, as compared with the conventional position adjusting method, the treating time can be shortened. Also, the movement of the punch portion 60 can be started at a point of time whereat the width direction deviation detecting operation has been performed, that is, before the sheet S arrives at the punch portion 60, and therefore the time required for the punching process can be greatly shortened and as the result, it is possible to construct an image forming system of which the productivity is not spoiled by the punching process even when the sheet treating apparatus 103 carrying such a punch unit 50 thereon is connected to a high-speed image forming apparatus having high throughput.

While in the present embodiment, the case of a punch mode has been described as an example of the sheet working process, this is not restrictive, but if for example, the operating mode is a mode in which without performing the aligning operation of the sheet S as in the punch mode, the sheet working process is executed for the sheet S, of course the principle of the present invention can be applied to such an operating mode.

Also, while in the present embodiment, description has been made of a case when the punching process is carried out while the sheet S is conveyed, of course, the principle of the present invention can also be applied to such a construction that for example, the punching process is carried out with the sheet S once stopped on a conveying path, and the conveyance of the sheet S is resumed after the punching process.

Also, while in the present embodiment, design is made such that the control for the sheet treating apparatus 103 is effected by the sheet treating apparatus controlling portion 205, it is of course also possible to design each apparatus constituting the present system so as to be controlled by only the CPU circuit portion 200.

Also, in the present embodiment, there has been shown by way of example a construction in which the side edge detecting portion as a detecting sensor for detecting the positional deviation amount of each conveyed sheet from the reference position in the sheet width direction is provided upstream of the image forming portion in the image forming apparatus main body 102. The side edge detecting portion, however, may be provided downstream of the image forming portion.

Figure 11:
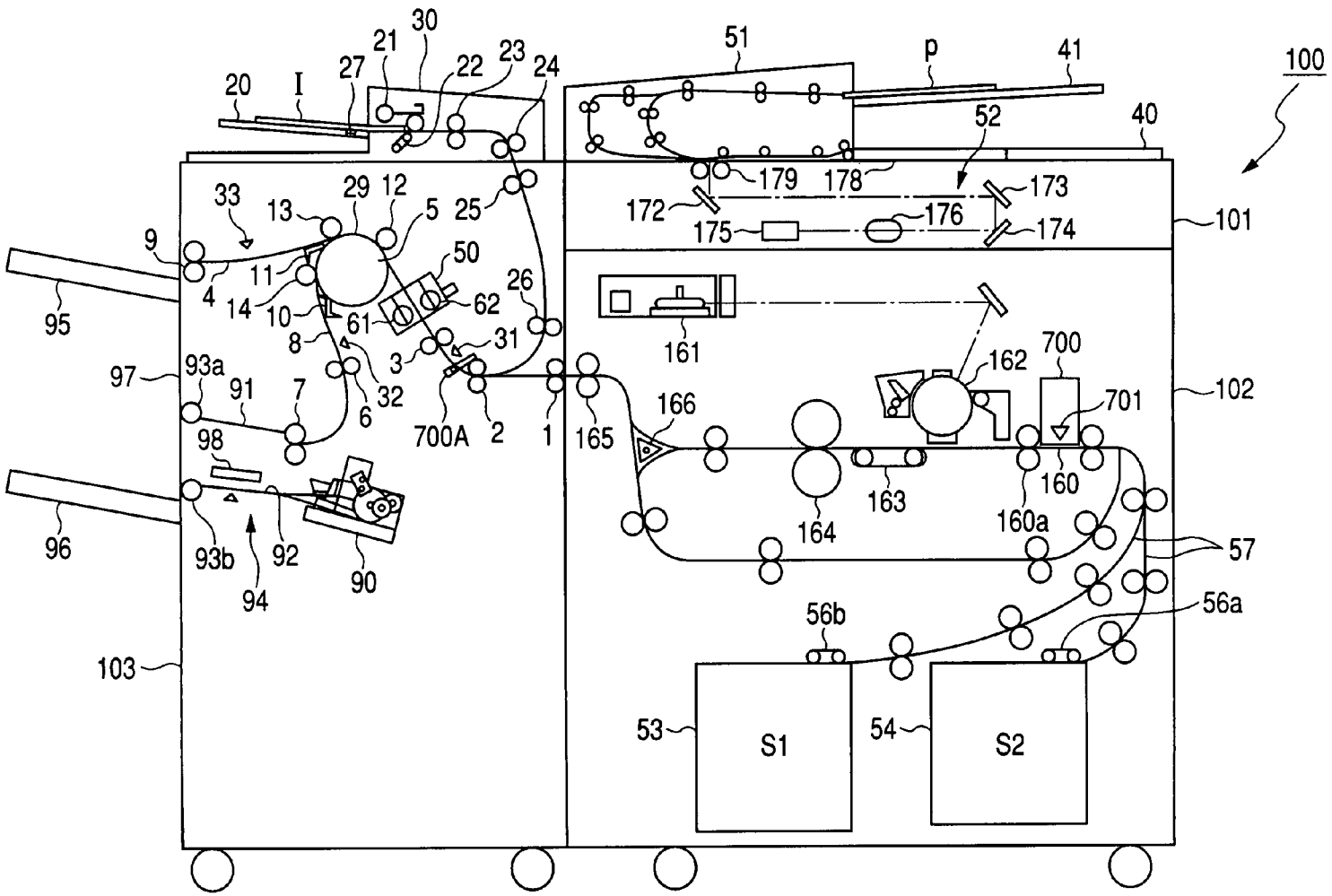
FIG. 11 typically shows the construction of an image forming system according to another embodiment of the present invention.

Also, as shown in FIG. 11, a side edge detecting portion 700A as a detecting sensor may be provided in the sheet treating apparatus 103, and the punch unit may be moved on the basis of the result of detection by the side edge detecting portion 700A as in the above-described embodiment.

Also, while a construction provided with a photosensor as a side edge detecting sensor has been shown by way of example, an image sensor such as a charge coupled device (CCD) or a contact image sensor (CIS) may be used as the side edge detecting sensor to thereby detect the position of the sheet in the width direction thereof.

The present invention is not restricted to the apparatus according to the above-described embodiment, but may be applied to a system comprised of a plurality of devices, or an apparatus comprising a single device.

Of course, the object of the present invention is also achieved by a system or an apparatus being supplied with a storage medium (or a recording medium) having recorded therein the program code of software realizing the function of the aforedescribed embodiment, and the computer (or the CPU or the MPU) of the system or the apparatus reading out and executing the program code stored in the storage medium. In this case, the program code itself read out from the storage medium realizes the function of the aforedescribed embodiment, and the storage medium storing the program code therein constitutes the present invention.

Also, as the storage medium for supplying the program code, use can be made, for example, a Floppy (registered trademark) disk, a hard disk, a magneto-optical disk, a CD-ROM, a CD-R, a CD-RW, a DVD-ROM, a DVD-RAM, a DVD-RW, a DVD-RW, a magnetic tape, a non-volatile memory card, a ROM or the like. Or the program code may be downloaded through a network.

Also, by executing the program code read out by the computer, not only the function of the aforedescribed embodiment is realized, but also of course, there is covered a case where on the basis of the instructions of the program code, an operating system (OS) or the like working on the computer effects part or the whole of actual processing, and the function of the aforedescribed embodiment is realized by the processing.

Further, of course, there is also covered a case where the program code read out from the storage medium is written into a memory provided in a function enlarging card inserted in the computer or a function enlarging unit connected to the computer, whereafter on the basis of the instructions of the program code, a CPU or the like provided in the function enlarging card or the function enlarging unit effects part or the whole of actual processing, and the function of the aforedescribed embodiment is realized by the processing.

This application claims priority from Japanese Patent Application No. 2004-085512 filed on Mar. 23, 2004, which is hereby incorporated by reference herein.

What is claimed is:

1. An image forming system comprising:

a sheet conveying path on which a sheet is conveyed, the sheet having a side edge substantially parallel to the direction of conveyance;

an image forming unit which forms an image on the sheet conveyed on the sheet conveying path;

a punching member which effects punching on the sheet conveyed on the sheet conveying path;

a detecting unit which detects each of a position of the side edge of a preceding sheet on the sheet conveying path and a position of the side edge of a succeeding sheet on the sheet conveying path at a location upstream of said punching member in the sheet conveying direction;

a moving mechanism which moves said punching member in the sheet width direction; and a controlling portion which controls said moving mechanism so as to move said punching member based on the position of the side edge of the sheet detected by the detecting unit, wherein during a single job said controlling portion calculates a difference between the position of the side edge of the preceding sheet detected by said detecting unit and the position of the side edge of the succeeding sheet detected by said detecting unit, and said controlling portion controls said moving mechanism so as to move said punching member from a punching position at which the punching member punches the preceding sheet to a next punching position at which the punching member punches the succeeding sheet along the sheet width direction, on the basis of the calculated difference.

2. An image forming system according to claim 1, wherein said detecting unit detects a positional deviation amount of each conveyed sheet from a reference position in the sheet width direction thereof, and said controlling portion calculates a movement amount of said punching member from the punching position for the preceding sheet to the next punching position for the succeeding sheet in the sheet width direction on the basis of a difference between a positional deviation amount of the preceding sheet detected by the detecting unit and a positional deviation amount of the succeeding sheet detected by said detecting unit, and controls said moving mechanism so as to move said punching member by the calculated movement amount in the sheet width direction from the punching position for the preceding sheet after the punching at the punching position for the preceding sheet by said punching member.

3. An image forming system according to claim 2, wherein said controlling portion calculates, for a first sheet, a movement amount of said punching member from an initial position thereof in the sheet width direction to a punching position for the first sheet on the basis of a positional deviation amount of the first sheet from a reference position in the sheet width direction detected by said detecting unit, and controls said moving mechanism so as to move said punching member by the calculated movement amount in the sheet width direction from the initial position.

4. An image forming system according to claim 3, wherein said initial position of said punching member is set for each size of the sheet in the sheet width direction.

5. An image forming system according to claim 2, wherein the reference position is set for each size of the sheet in the sheet width direction.

6. An image forming system according to claim 1, further comprising a sheet feeding member which feeds the sheet to said image forming unit, wherein said detecting unit is disposed upstream of the image forming position to detect the sheet conveyed on said sheet conveying path.

7. An image forming system according to claim 6, wherein an image formation start position in a main scanning direction by said image forming unit is corrected in accordance with the position of the sheet detected by said detecting unit.

8. An image forming system according to claim 1, further comprising:

a sheet feeding member which feeds the sheet to said image forming unit; and a two-side conveying path which, when images are to be formed on two sides of the sheet, reverses the sheet on a first side of which an image has been formed, and directs the sheet to a position in which said sheet conveying path joins said two-side conveying path, wherein said detecting unit is disposed between the position in which said sheet conveying path joins said two-side conveying path and the image forming position.

9. An image forming system according to claim 8, wherein an image formation start position in a main scanning direction by said image forming unit is corrected in accordance with the position of the sheet detected by said detecting unit.

10. An image forming system according to claim 9, further comprising detecting operation controlling means for controlling an operation of detecting the position of the sheet by said detecting unit, wherein said detecting operation controlling means controls, when an image is to be formed on only one side of the sheet, so that the detecting operation of said detecting unit is performed before an image formation on the first side, and when images are to be formed on the two sides of the sheet, so that the detecting operation of said detecting unit is performed after the image formation on the first side and before an image formation on a second side.

11. An image forming system according to claim 1, wherein a size of the preceding sheet in the sheet width direction is the same as a size of the succeeding sheet in the sheet width direction.

* * * * *